US005222615A

United States Patent [19]

Ota et al.

[11] Patent Number: 5,222,615

[45] Date of Patent: Jun. 29, 1993

[54] CONTAINER HAVING SUPPORT STRUCTURE IN ITS BOTTOM SECTION

[75] Inventors: Akiho Ota, Funabashi; Yoshiaki Hayashi, Tokyo; Takao Iizuka, Matsudo, all of Japan

[73] Assignee: Yoshino Kogyosho Co., Ltd., Tokyo, Japan

[21] Appl. No.: 876,135

[22] Filed: Apr. 29, 1992

Related U.S. Application Data

[63] Continuation of Ser. No. 790,018, Nov. 5, 1991, abandoned, which is a continuation of Ser. No. 453,164, Dec. 19, 1989, abandoned, which is a continuation of Ser. No. 253,322, Oct. 3, 1988, abandoned, which is a continuation of Ser. No. 14,214, Feb. 5, 1987, abandoned, which is a continuation of Ser. No. 760,532, Jul. 30, 1985, abandoned.

[51] Int. Cl.[5] ..... B65D 23/00

[52] U.S. Cl. ..... 215/1.000 C; 220/675

[58] Field of Search ..... D9/520, 540, 543, 560, D9/553, 557, 570; 215/1 C, 31; 220/669, 674, 675

[56] References Cited

U.S. PATENT DOCUMENTS

| | | | |
|---|---|---|---|
| D. 12,292 | 6/1881 | Babcock | D9/401 |
| D. 171,647 | 3/1954 | Hills . | |
| D. 194,564 | 2/1963 | Mojonnier | D9/403 |
| D. 205,380 | 7/1966 | Kelly | D9/383 |
| D. 240,800 | 8/1976 | Jespersen | D9/410 X |
| D. 267,233 | 12/1982 | Aoki . | |
| D. 268,324 | 3/1983 | Gautier | D9/409 X |
| D. 275,267 | 8/1984 | Gautier | D9/409 X |
| D. 277,362 | 1/1985 | Epperson | D9/370 |
| D. 278,887 | 5/1985 | Steiner | D9/403 |
| D. 292,378 | 10/1987 | Brandt et al. | D9/396 |
| D. 294,120 | 2/1988 | Griesing et al. | D9/403 |
| D. 294,679 | 3/1988 | Griesing et al. | D9/411 X |
| 2,936,920 | 5/1960 | Wallace | 215/1 C |
| 3,225,950 | 12/1965 | Josephsen et al. | 215/1 C |
| 3,286,902 | 11/1966 | Hunter et al. | 720/72 X |
| 3,366,290 | 1/1968 | Mojonnier et al. | 215/1 C |
| 3,397,724 | 8/1968 | Bolen et al. . | |
| 3,403,804 | 10/1968 | Colombo | D9/399 X |
| 3,458,617 | 7/1969 | Isley et al. | 215/1 C |
| 3,536,223 | 10/1970 | Muhlhoff et al. | 215/1 C |
| 3,598,270 | 8/1971 | Adomaitis | 215/1 C |
| 3,708,082 | 1/1973 | Platte . | |
| 3,722,725 | 3/1973 | Khetani et al. . | |
| 3,727,783 | 4/1973 | Carmichael | 215/1 C |
| 3,825,049 | 7/1974 | Swett et al. | 220/70 X |
| 3,871,541 | 3/1975 | Adomaitis | 215/1 C |
| 3,921,630 | 11/1975 | McPhee | 215/1 C X |
| 3,935,955 | 2/1976 | Das | 215/1 C |
| 4,199,629 | 4/1980 | Agrawal | 215/1 C X |
| 4,318,882 | 3/1982 | Agrawal et al. . | |
| 4,355,728 | 10/1982 | Yoshino et al. . | |
| 4,379,099 | 4/1983 | Ota et al. . | |
| 4,520,936 | 6/1985 | Lyons | 215/1 C |
| 4,589,560 | 5/1986 | Harris, Jr. | 215/1 C |
| 5,931,074 | 1/1986 | Gomez | 215/1 C |

FOREIGN PATENT DOCUMENTS

| | | | |
|---|---|---|---|
| 1413545 | 11/1964 | France | 215/1 C |
| 2449045 | 10/1980 | France | 220/70 |
| 54-30654 | 2/1979 | Japan . | |
| 57-126310 | 8/1982 | Japan . | |
| 55-9544-4 | 12/1983 | Japan . | |
| 59-66708 | 5/1984 | Japan . | |
| 1213528 | 11/1970 | United Kingdom | 215/1 C |
| 1239531 | 7/1971 | United Kingdom . | |
| 1406958 | 9/1975 | United Kingdom . | |

OTHER PUBLICATIONS

"Gatorade Tests Bottle of Future", *Packaging*, Oct. 1987.

*Primary Examiner*—Bryon P. Gehman
*Attorney, Agent, or Firm*—Oliff & Berridge

[57] ABSTRACT

A hollow blow-molded container of a biaxially oriented thermoplastic material in which the container bottom section contains support panels or structures. The support panels prevent uneven shrinkage and help minimize rocking of the container by maintaining the uniformity of the bottom section during fabrication.

18 Claims, 3 Drawing Sheets

CONTAINER HAVING SUPPORT STRUCTURE IN ITS BOTTOM SECTION

This is a continuation of application Ser. No. 07/790,018 filed Nov. 5, 1991, now abandoned, which in turn is a continuation of application Ser. No. 07/453,164 filed Dec. 19, 1989, now abandoned, which in turn is a continuation of application Ser. No. 07/253,322 filed Oct. 3, 1988, now abandoned, which in turn is a continuation application Ser. No. 07/014,214 filed Feb. 5, 1987, now abandoned, which in turn is a continuation of application Ser. No. 06/760,532 filed Jul. 30, 1985, now abandoned.

BACKGROUND OF THE INVENTION

The present invention relates to hollow blow-molded containers of a biaxially oriented thermoplastic material, and more particularly to thin-walled plastic containers configured to accommodate partial evacuation without adverse effects on their appearance.

Lightweight, thin-walled containers made of thermoplastic materials such as polyester resin and thermoplastic polymers containing at least 50% by weight polymerized nitrile-group-containing monomer (hereinafter "nitriles") are well known in the container industry. For example, polyethylene terephthalate (PET) has a wide range of applications in the field of containers for foodstuffs, flavoring materials, cosmetics, beverages and so on. PET can be molded, by orientation-blowing, into transparent thin-walled containers having a high stiffness, impact strength and improved hygienic qualities with a high molding accuracy. Strong, transparent and substantially heat resistant containers may be produced by the biaxial-orientation blow-molding process in which a tubular parison is oriented both laterally and longitudinally in a temperature range suitable for such orientation. Nitrile and heat-set PET containers are particularly heat resistant. Biaxially-oriented blow-molded containers have greater stiffness and strength as well as improved gas barrier properties and transparency.

As noted above, a tubular parison is generally utilized to make cylindrical or other shaped containers. When a cylindrical container is formed from a tubular parison, orientation and stretch levels around the circumference of the container are relatively uniform. However, when a non-cylindrical container is formed from a tubular parison, stretching problems occur during fabrication. Particularly in the base of the container, unequal stretching may result in unequal and not regularly repeatable shrinkage after the tubular parison is stretched into, for instance, a square cross-sectional shape. This problematical shrinkage is particularly undesirable in the bottom section of the container at the seating ring and up to the body section of the container, and results from highly stretched corners and less stretched middle sections and sides. This can result in the container rocking instead of sitting flat upon a shelf or the like, or having visible deformations. Similar though less extreme problems arise in the shoulder section of the container.

Also, when a thermoplastic container is filled with a hot liquid (such as a liquid sterilized at a high temperature) and sealed, subsequent thermal contraction of the liquid upon cooling results in a partial evacuation of the container which tends to deform the container walls and bottom section. Backflow into a filling mechanism and the use of vacuum filling equipment during filling operations can similarly create a partial vacuum inside the container resulting in its deformation. Such deformation typically concentrates at the mechanically weaker portions of the container, such as the unevenly stretched bottom section, resulting in an exaggerated irregular seating surface and commercially unacceptable appearance. This problem is exacerbated when the container body includes collapse panels, indented surface areas which provide for controlled, quantified collapse of the container upon evacuation.

By increasing the thickness of the container it is possible to some extent to strengthen the container and decrease the effects of vacuum deformation. However, increasing the thickness of the container results in a substantial increase in the amount of raw materials required to produce the container and a substantial decrease in production speed. The resultant increased costs are not acceptable to the container industry. Additionally, even with increased container thickness, there still is uneven stretching around the bottom section of a non-cylindrical container.

A prior attempt to reduce the effects of vacuum deformation is disclosed in U.S. Pat. No. 4,355,728. This patent discloses a container having bulges in the bottom section to stabilize the container upon contacting a rest surface and also to provide endurance against elevated pressure within the container. A similar prior approach to reduce the effects of vacuum deformation in the bottom section of a container is disclosed in British Patent Specification No. 1,406,958.

Prior art approaches have included the use of outwardly extending bulges or radially inwardly extending ribs in the radially inner end portion of the bottom section of containers to accommodate controlled deformation and to eliminate rocking of the container upon a rest surface. However, these prior art approaches are of complex design and improvements therein are required.

SUMMARY OF THE INVENTION

The present invention relates to a hollow blow-molded container of biaxially-oriented thermoplastic material having a non-cylindrical body, wherein the radially outer portion of the container bottom section contains support panels.

The support panels in the bottom section increase the strength of the container and stabilize the container against rocking. The support panels compensate for uneven stretching of the container, and are particularly useful with heat-set containers. The container can accommodate large evacuation effects by controlled, uniform vacuum deformation.

DETAILED DESCRIPTION OF PREFERRED EMBODIMENTS OF THE INVENTION

Figure 1:
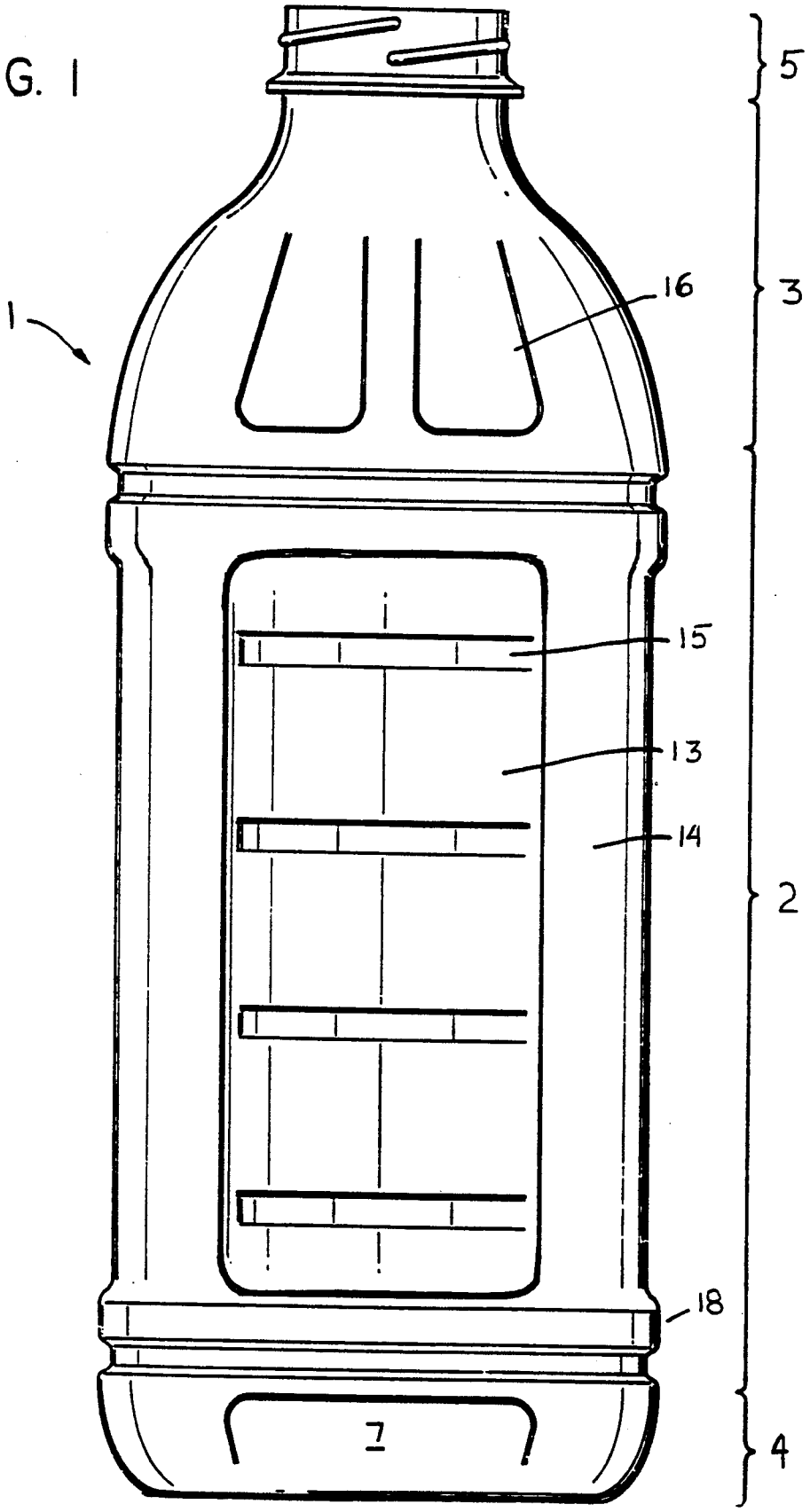
FIG. 1 is a side view of a cross-sectionally rectangular container of the present invention.

Referring now to the drawings, FIG. 1 depicts a thinwalled blow-molded plastic container 1 which may be formed of a hot-fillable material (a material which safely permits filling of the container with contents at temperatures of 65°-100° C., more generally 75°-95° C.)

such as polyethylene terephthalate (PET) or a nitrile. The container 1 comprises a body section 2 having a shoulder portion 3. The body section can be of any polygonal shape, for example, rectangular (FIG. 3), square, hexagonal or octagonal, preferably rectangular or square. The lower end of the body section 2 terminates at a radially delineated from the body section 2 by a circumscribing annular rib portion 18 as shown in FIG. 1. The body section 2 extends upwardly from the bottom section 4 and the top of body section 2 tapers radially inwardly to form the shoulder section 3 which terminates at a neck section 5. The neck section 5 may include external threads for a closure (not shown) and the neck section 5 may be crystallized to provide thermal, chemical and mechanical strength in the unstretched neck section as disclosed, for instance, in U.S. Pat. No. 4,379,099.

Figure 2:
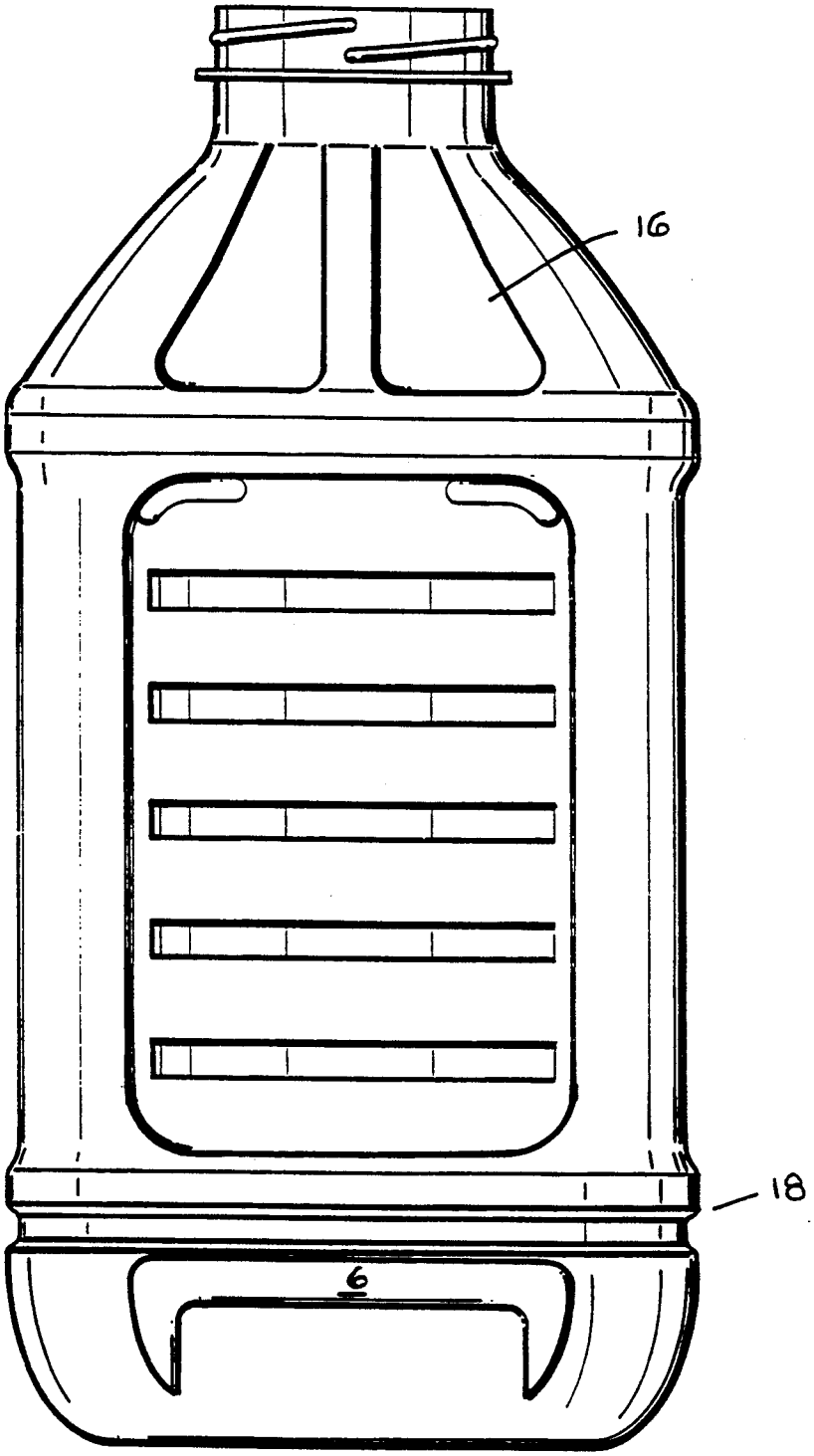
FIG. 2 is a side view of a cross-sectionally square container of the present invention.
Figure 4:
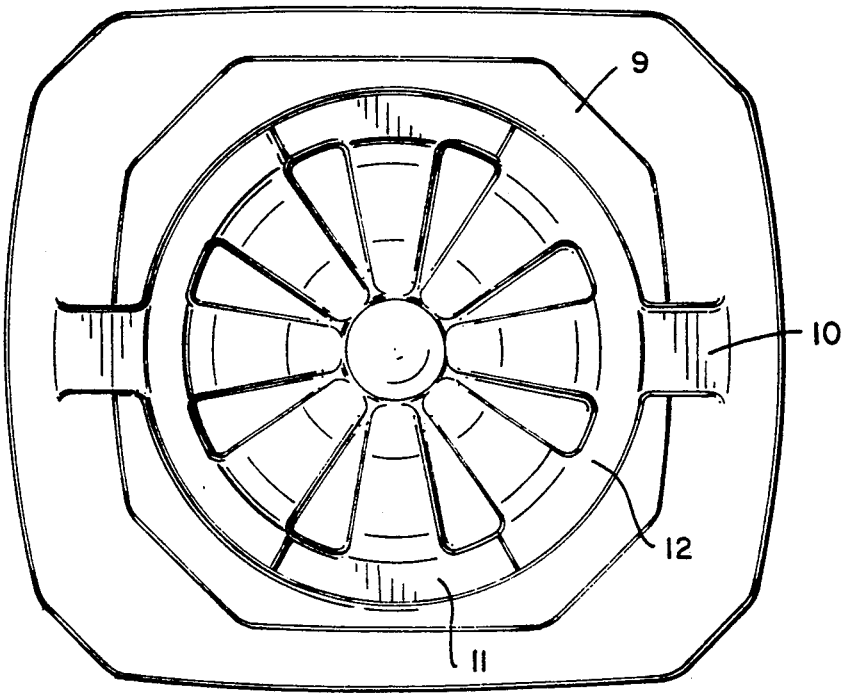
FIG. 4 is a bottom view of the container of FIG. 1.

The bottom section 4 of container 1 shown in FIGS. 1 and 2 is provided with a plurality of support panels 6,7 and is defined between the annular rib portion and a seating ring 9. For instance, a support panel 6,7 can be provided in each side of the bottom section 4. Also, fewer support panels than sides can be provided in the bottom section 4, for instance on alternating sides. The number of support panels utilized in the bottom section of the container is selected based on the amount and uniformity of stretch resulting during fabrication of the container and the size and shape of the container.

The support panels may be in the shape of an indented or raised polygon such as a square or rectangle 7 (FIG. 1), may be circular or ovoid, or may be open-sided and defined by an inverted "U" shaped indented or projecting rib 6 (FIG. 2). Furthermore, a number of the support panels may be provided on a single side of the bottom section 4 of the container. It is preferred that the width of the single panel or group of panels on a side comprises 20–85%, more preferably 40–70%, of the width of the side. It is preferred that the height of the single panel or group of panels on a side comprises 10–90%, more preferably 45–80%, of the height of the bottom section 4 of the container.

Figure 3:
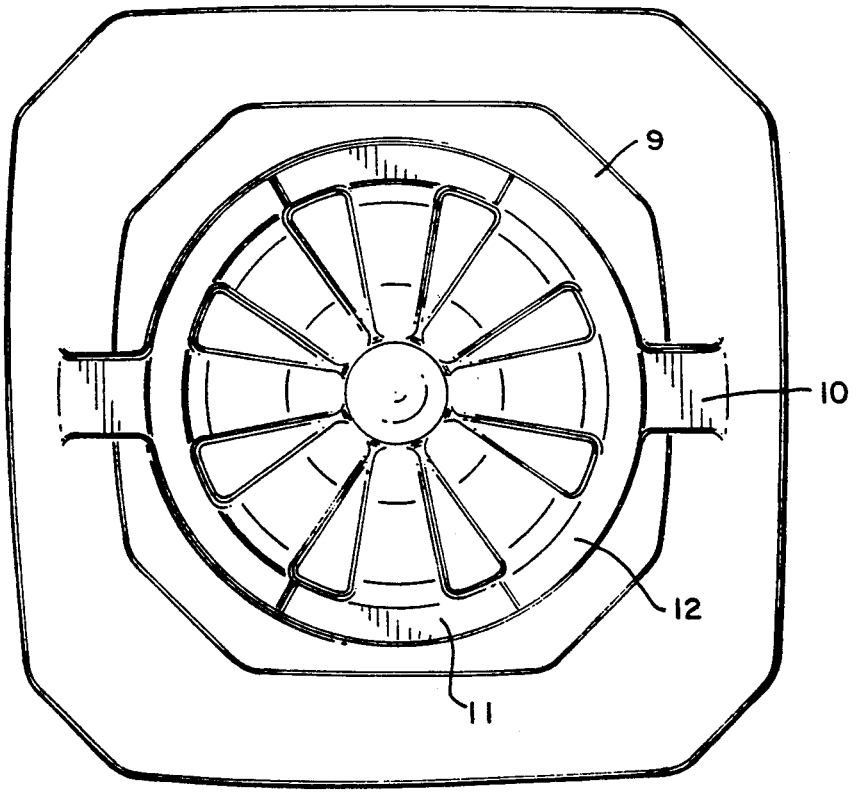
FIG. 3 is a bottom view of the container of FIG. 2.

The support panels compensate for unequal stretching of the sides of the bottom section of the container, and are thus particularly useful with containers having sides of different lengths, such as cross-sectionally rectangular containers. In such containers, the support panels may be present only on the longer sides of the bottom section of the container, although they may also be present on some or all of the shorter sides as well. In containers with fewer support panels than sides, it may be desirable to ensure regularity of the seating ring 9 by providing further indentations on or adjacent the seating ring itself. For example, in the cross-sectionally rectangular container of FIG. 3, support panels are only present on the longer sides of the bottom section. In the embodiment of FIG. 3, indentations 10 are provided on the portions of the seating ring 9 opposite the shorter sides of the container. Further indentations 11 are provided radially inwardly of and adjacent to the portions of the seating ring opposite the longer sides of the container, on a radially inward annular ring 12. This construction results in a particularly stable seating ring in spite of significant differences in degree of stretch.

As similar problems arise at the shoulder portions of unequally stretched containers, the invention also contemplates the use of similar support panels 16 on the sides of the shoulder section.

In a preferred embodiment, the body portion 2 of the container is specifically configured to accommodate controlled changes of the volume of the container upon its partial evacuation. As shown in FIG. 1, collapse panels 13 are formed on some or all sides of the body section 2. A collapse panel 13 may be formed at each side of the polygonal body section 2, and adjacent collapse panels 13 are separated from each other by lands 14. Collapse panels may alternatively be formed on fewer than all sides of the container, for instance, on alternating sides. The collapse panels are elongated along the longitudinal axis of the container, and have a generally rectangular or oval shape. Preferably, each collapse panel contains one or more reinforcing ribs 15 which serve to strengthen the collapse panels 13. The number of ribs per panel depends on the width and height of the collapse panel, as well as the type and thickness of material forming the container. That is, different materials exhibit different degrees of resistance to deformation and therefore the requisite number of reinforcing ribs per collapse panel will change accordingly. Additionally, the conditions under which the container is filled and the nature of the contents to be filled into the container will affect the number of reinforcing ribs required. The determination of the number of ribs per collapse panel based on the type of material of the container, the contents to be filled into the container and the temperature of filling can be made by those of ordinary skill in the art upon routine experimentation.

The following examples will illustrate the invention, but are not intended to limit the scope of the patent as defined in the claims appended hereto.

EXAMPLES

Comparative Example A

A 64-ounce, cross-sectionally square container was biaxial-orientation blow-molded from a tubular parison. No support panels were provided in the bottom of the container. Upon removal from the mold, the container was found to include inward deformations on the sides of its bottom portion. The appearance was unacceptable for commercial use.

Comparative Example B

A 64-ounce, cross-sectionally rectangular container was biaxial-orientation blow-molded from a tubular parison. No support panels were provided in the bottom of the container, which had the dimensions 115 mm×98.5 mm×245 mm high. Upon removal from the mold, the container was found to include inward deformations on the longer sides of its bottom portion. The seating ring was wavy and uneven, and could not support the container in a single stable position without rocking. The appearance and stability were unacceptable for commercial use.

EXAMPLE 1

A container as described in Comparative Example A was biaxial-orientation blow-molded from a tubular parison with an indented rectangular support panel on each side of the bottom section of the container. Upon removal from the mold, the container was found to be free of deformation in its bottom section and seating ring, and was thus of acceptable appearance and stability.

EXAMPLE 2

A container as described in Comparative Example B was formed with an inverted "U" shape support panel in each of the longer sides of the bottom portion, an indentation in the seating ring opposite each of the short sides of the container, and an indentation in a radially inward annular ring adjacent to the seating ring opposite each of the longer sides of the container. Upon removal from the mold, the container was found to be free of deformations in its bottom section and seating ring, and was thus of acceptable appearance and stability.

Various modifications and alterations of the present invention will be readily apparent to persons skilled in the art. It is intended, therefore, that the foregoing be considered as exemplary and that the scope of the invention be limited only by the following claims.

What is claimed is:

1. A thin-walled container made of thermoplastic material, said container being formed by blow-molding a tubular parison, being of substantially rectangular shape in cross section, and comprising a neck section, a body section, a tapering shoulder section and a bottom section; said tapering shoulder section being located between said neck section and said body section; said bottom section being adjacent said body section and delineated therefrom by a circumscribing annular rib, said bottom section being defined between a seating ring at a bottom end of said container and said annular rib; said bottom section including four sides each being inclined upwardly from said seating ring toward said annular rib, at least one of said sides including at least one indented or projecting support panel defined within said at least one of said sides; and said seating ring including at least one indentation.

2. The container of claim 1, wherein said container is of a square shape in cross section.

3. The container of claim 1, wherein each of said sides includes at least one said support panel therein.

4. The container of claim 1, wherein only alternating ones of said sides include at least one said support panel therein.

5. The container of claim 4, wherein said seating ring is indented at portions of said seating ring opposite the sides of said bottom section which lack a support panel.

6. The container of claim 5, further comprising a radially inward annular ring adjacent said seating ring, said annular ring comprising indentations adjacent portions of said seating ring opposite those sides of said bottom section which include at least one said support panel.

7. The container of claim 1, wherein said body section includes a plurality of collapse panels.

8. The container of claim 7, wherein at least one of said plurality of collapse panels in said body section includes at least one reinforcing rib extending therewithin.

9. The container of claim 1, wherein said material is heat set polyethylene terephthalate.

10. The container of claim 1, wherein said material is a nitrile.

11. The container of claim 1, wherein said shoulder section includes a plurality of support panels.

12. The container of claim 1, wherein each side of said bottom section and each side of said shoulder section includes a support panel.

13. The container of claim 1, wherein said shoulder section has four sides.

14. A thin-walled container made of thermoplastic material, said container being formed by blow-molding a tubular parison, being a substantially four-sided container and comprising a neck section, a body section, a tapering shoulder section and a bottom section; said tapering shoulder section being located between said neck section and said body section; said bottom section being adjacent said body section and delineated therefrom by a circumscribing annular rib, said bottom section being defined between a seating ring at a bottom end of said container and said annular rib; said body section having four substantially vertical sides; said shoulder section containing at least one indented or projecting support panel; said bottom section having four sides, each side being inclined upwardly from said seating ring toward said annular rib, and at least one of said sides containing at least one indented or projecting support panel defined within said at least one of said sides; said seating ring including at least one indentation.

15. The container of claim 14, comprising at least one support panel on each of said sides of said shoulder section.

16. The container of claim 14, comprising two support panels on each of said sides of said shoulder section.

17. The container of claim 14, wherein said bottom section comprises a plurality of support panels on said sides of said bottom section.

18. The container of claim 14, wherein said bottom section comprises a support panel on each of said sides of said bottom section.

* * * * *